US009835379B2

(12) United States Patent
Daley et al.

(10) Patent No.: US 9,835,379 B2
(45) Date of Patent: Dec. 5, 2017

(54) HOT WATER DISTRIBUTION SYSTEM AND METHOD FOR A COOLING TOWER

(71) Applicant: Composite Cooling Solutions, L.P., Fort Worth, TX (US)

(72) Inventors: Toby Daley, Fort Worth, TX (US); James A. Bland, Rhome, TX (US); Michael Bickerstaff, Fort Worth, TX (US)

(73) Assignee: Composite Cooling Solutions, L.P., Fort Worth, TX (US)

( * ) Notice: Subject to any disclaimer, the term of this patent is extended or adjusted under 35 U.S.C. 154(b) by 346 days.

(21) Appl. No.: 14/075,608

(22) Filed: Nov. 8, 2013

(65) Prior Publication Data

US 2014/0138859 A1 May 22, 2014

Related U.S. Application Data

(63) Continuation of application No. 13/077,834, filed on Mar. 31, 2011, now Pat. No. 8,602,397.

(60) Provisional application No. 61/319,810, filed on Mar. 31, 2010.

(51) Int. Cl.

| | |
|---|---|
| ***F28C 3/04*** | (2006.01) |
| ***B01F 3/04*** | (2006.01) |
| ***F28F 25/02*** | (2006.01) |
| ***F28F 25/06*** | (2006.01) |

(52) U.S. Cl.

CPC ..... *F28C 3/04* (2013.01); *B01F 3/04* (2013.01); *F28F 25/02* (2013.01); *F28F 25/06* (2013.01)

(58) Field of Classification Search

CPC ..... B01F 3/04

USPC ..... 261/94, 97, 98, DIG. 11; 165/174

See application file for complete search history.

(56) References Cited

U.S. PATENT DOCUMENTS

| | | | |
|---|---|---|---|
| 3,899,553 | A | 8/1975 | Furlong et al. |
| 5,180,103 | A | 1/1993 | Harrison, Jr. et al. |
| 5,180,528 | A | 1/1993 | Kaplan |
| 5,364,569 | A | 11/1994 | Bugler, III |

(Continued)

FOREIGN PATENT DOCUMENTS

| | | | |
|---|---|---|---|
| CN | 1173143 | A | 2/1998 |
| CN | 101065632 | A | 10/2007 |
| EP | 0526188 | B1 | 6/1997 |

OTHER PUBLICATIONS

Office Action dated Jun. 24, 2014 in connection with Chinese Patent Application No. 201180026979.4.

(Continued)

*Primary Examiner* — Robert A Hopkins

(57) ABSTRACT

A cooling tower with a hot water distribution system includes a distribution lateral disposed above a hot water basin. The distribution lateral discharges fluid into the hot water basin, which in turn, releases the fluid through a plurality of orifices. As the fluid is released, it falls on heat-exchanging fill material that assists in increasing the cooling rate of the fluid. The distribution lateral is configured structurally to discharge the fluid through a plurality of outlets at one or more angles (as compared to the horizontal) into the hot water basins. In one embodiment, the outlets are arranged into one or more rows that extend along a substantial length of the distribution lateral. Discharging the fluid in this manner enhances and promotes a more even fluid flow within the hot water basin, which results in a more even fluid flow over and onto the fill material, thereby increasing thermal efficiency.

21 Claims, 7 Drawing Sheets

(56) References Cited

U.S. PATENT DOCUMENTS

| | | | |
|---|---|---|---|
| 5,545,356 | A | 8/1996 | Curtis et al. |
| 5,770,117 | A | 6/1998 | Phelps |
| 5,902,522 | A | 5/1999 | Seawell et al. |
| 6,070,860 | A | 6/2000 | Kinney, Jr. et al. |
| 7,128,310 | B2 | 10/2006 | Mockry et al. |
| 7,275,734 | B2 | 10/2007 | Bland et al. |
| 2007/0296093 | A1 | 12/2007 | Russel-Smith |

OTHER PUBLICATIONS

"Sigma 160 Series", Marley Cooling Tower Company, 1996, 12 pages.

"Sigma Steel CoolingTower", Marley Cooling Tower Company, 2000, 14 pages.

International Search Report dated Aug. 12, 2011 in connection with International Patent Application No. PCT/US2011/030822.

Written Opinion of the International Searching Authority dated Aug. 12, 2011 in connection with International Patent Application No. PCT/US2011/030822.

HOT WATER DISTRIBUTION SYSTEM AND METHOD FOR A COOLING TOWER

CROSS-REFERENCE TO RELATED APPLICATION

This application is a continuation of prior application Ser. No. 13/077,834, filed on Mar. 31, 2011, which claims priority under 35 USC 119(e) to U.S. provisional Application Ser. No. 61/319,810, filed on Mar. 31, 2010, and which are incorporated herein by reference.

TECHNICAL FIELD OF THE INVENTION

The present invention relates to cooling towers, and in particular, to a hot water basin and distribution system for use in cooling towers, including crossflow cooling towers.

BACKGROUND

Most cooling towers are classified as either open or closed. Open cooling towers are configured generally as crossflow or counterflow designs. Conventional crossflow cooling towers have the cooling water flowing downward with air flowing perpendicular to the cooing fluid flow. In contrast, conventional counterflow cooling towers have the cooling water flowing downward with the air flowing parallel to the water flow.

The fluid distribution systems in cooling towers are generally of two types: gravity and spray. Spray systems are normally used in counterflow towers while gravity systems are utilized in crossflow towers. In a spray distribution system, spray nozzles are mounted to the distribution pipes. In a gravity distribution system, hot water reservoirs (commonly referred to as a basin or pan) disposed above heat-exchanging material (commonly referred to as "fill" material) include orifices (holes, passageways) configured in the bottom of the basin that allow a gravity release of the water within the basin. In some systems, each orifice is configured with a "target" nozzle to manipulate the water as it falls on the fill material. As water is released and output through the orifices, the falling water contacts the heat-exchanging material below which assists in increasing the cooling rate of the water as it flows over the fill material.

As is well known in the art, the rate of cooling of the water is important. Efficiencies in the distribution system may increase the cooling rate or thermal performance of the cooling tower. Thus, an efficient hot water basin distribution system is important.

A conventional crossflow cooling tower typically includes two hot water basins 14, with each hot water basin located on opposite sides from each other and along an outer edge. FIG. 1 illustrates a portion of one hot water basin distribution system 12 on one side of a crossflow cooling tower 10. As illustrated, the hot water basin distribution system 12 includes the hot water basin 14 which is rectangular in shape, and further includes multiple outlet (discharge) pipes 16 spaced apart from each other. Each outlet 16 pipe includes an opening that is oriented to dispense water substantially vertically downward (substantially perpendicular to the horizontal). For each outlet pipe 16, a baffle 18 (in this case, rectangular shaped) and/or weirs are positioned around the outlet area in an attempt to provide more equal flow of water within the hot water basin 14.

The baffles are typically constructed to be raised above the bottom of the hot water basin a few inches or so. Without the baffles, the velocity of the discharged water as it spreads out through the hot water basin would be such that the water flowing through the bottom orifices (providing the gravity outlet to the wet deck) would be inefficient—as some orifices would output more or less water than others—resulting in thermal inefficiencies. This is undesirable. However, even with these baffle structures, water flow is relatively uneven resulting in less efficiency.

Accordingly, there is needed a system, method and apparatus for hot water distribution in crossflow cooling towers that increases water flow efficiency within the hot water basin and gravity distribution system to increase thermal performance of the cooling tower.

SUMMARY

In accordance with one embodiment, there is provided a hot water basin distribution system for use in a cooling tower. The system includes a hot water basin including a plurality of discharge orifices and a distribution lateral pipe disposed over the hot water basin. The pipe extends substantially horizontally and receives fluid from a distribution header pipe and discharges the received fluid into the hot water basin. The distribution lateral pipe includes a plurality of discharge outlets arranged in a first row and a second row extending along a substantial length of the distribution lateral pipe, and the first row discharges fluid at a first angle and the second row discharges fluid at a second angle from a horizontal.

In accordance with another embodiment, there is provided a method of cooling fluid within a cooling tower. The method includes (1) distributing fluid carried by a distribution header within the cooling tower into a distribution lateral structure; (2) discharging the fluid from the distribution lateral pipe through at least one row of discharge outlets arranged in a row along a substantial length of the distribution lateral pipe into a hot water basin; (3) releasing, through a plurality of orifices within the hot water basin, the fluid onto heat-exchanging material disposed below the hot water basin; and (4) collecting the fluid in a cold water basin, the fluid in the cold water basin having a temperature less than a temperature of the fluid in the hot water basin.

In yet another embodiment, there is provided a cooling tower for cooling fluid. The cooling tower includes a supporting structure supporting a motor, a fan, a fan stack, fill material and a fluid distribution system. The fluid distribution system includes a distribution header, a reservoir basin including a plurality of discharge orifices, and a distribution lateral disposed over the reservoir basin and extending substantially horizontally for receiving fluid from the distribution header and discharging received fluid into the reservoir basin. In addition, the distribution lateral includes a plurality of discharge outlets arranged in a first row and a second row extending along a substantial length of the distribution lateral pipe, wherein the first row discharges fluid at a first angle and the second row discharges fluid at a second angle from a horizontal of the distribution lateral.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION

Prior art crossflow cooling towers are disclosed in U.S. Pat. No. 6,070,860 to Kinney, et al. (1999), which is fully incorporated herein by reference, and U.S. Pat. No. 5,180,528 to Kaplan, which is also fully incorporated herein by reference. The present disclosure describes a hot water basin distribution system that can be utilized, integrated or incorporated in the cross-flow towers disclosed and described in U.S. Pat. No. 6,070,860 or U.S. Pat. No. 5,180,528, and can be used with one or more components of the cooling towers described therein. For example, the lateral distribution pipe and hot water basin described herein can be used to replace the hot water distributor 32 or the basin and hot water distribution pans 90 disclosed within the cooling tower(s) illustrated and described in U.S. Pat. No. 6,070,860. Similarly, for example, the lateral distribution pipe and hot water basin described herein can be used in place of all or part of the distribution system 10 within the cooling tower(s) disclosed in U.S. Pat. No. 5,180,528.

Prior art cooling towers using fiber-reinforced pultruded frame structures are disclosed in U.S. Pat. No. 6,275,734 to Bland, et al., which is fully incorporated herein by reference. The frame structures and cooling tower components described in U.S. Pat. No. 7,275,734 can be combined with the hot water basin distribution system described herein to form one or more embodiments of a crossflow cooling tower.

It will be understood that the term "water" used throughout this document, e.g., as used in "hot water basin" or "hot water basin distribution system basin", may refer to not only water, but to other "fluids" that may be utilized for cooling (heat exchange)) purposes.

Figure 1:
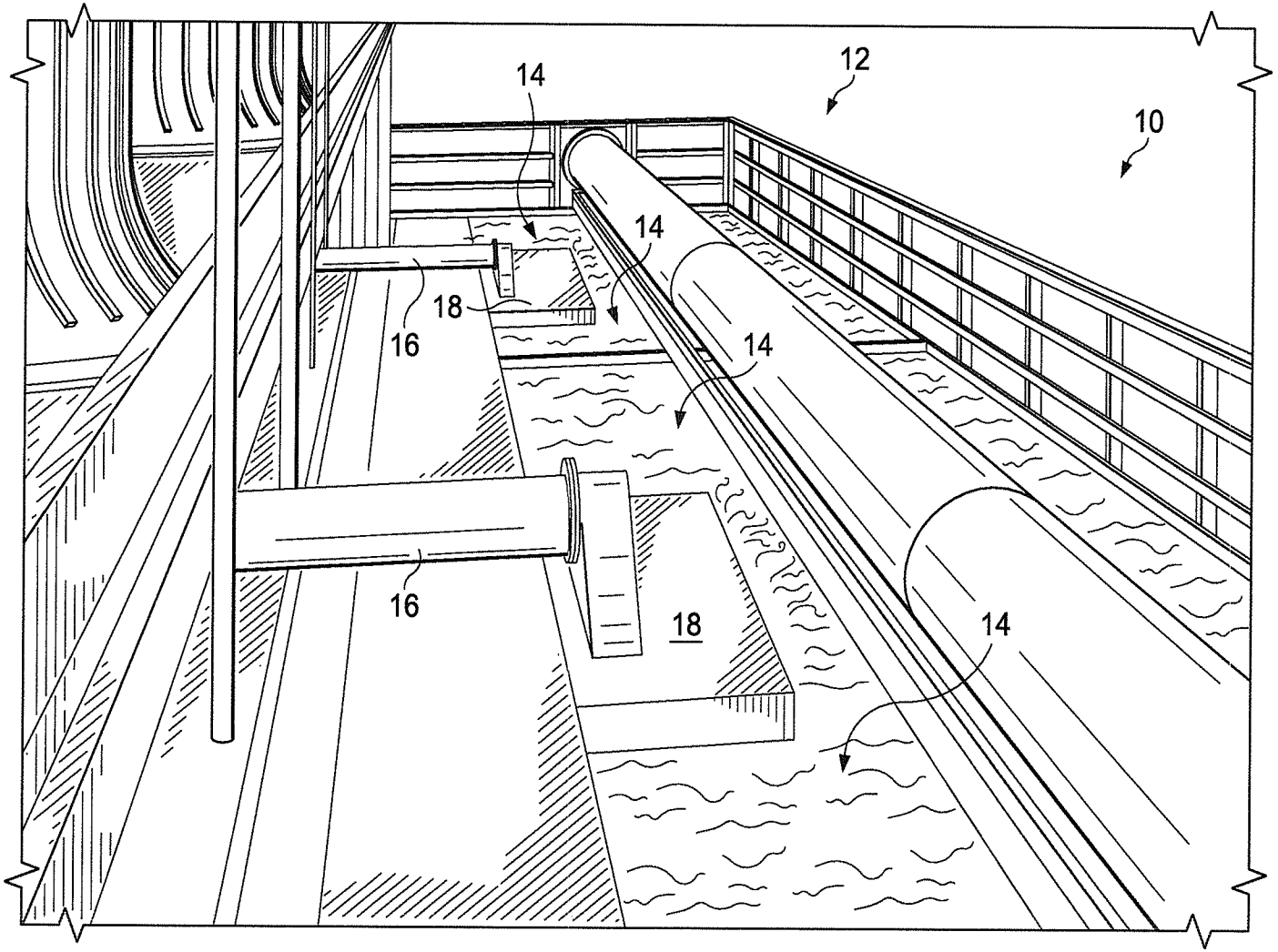
FIG. 1 illustrates a portion of a conventional prior art hot water basin and distribution system in a crossflow cooling tower.
Figure 2:
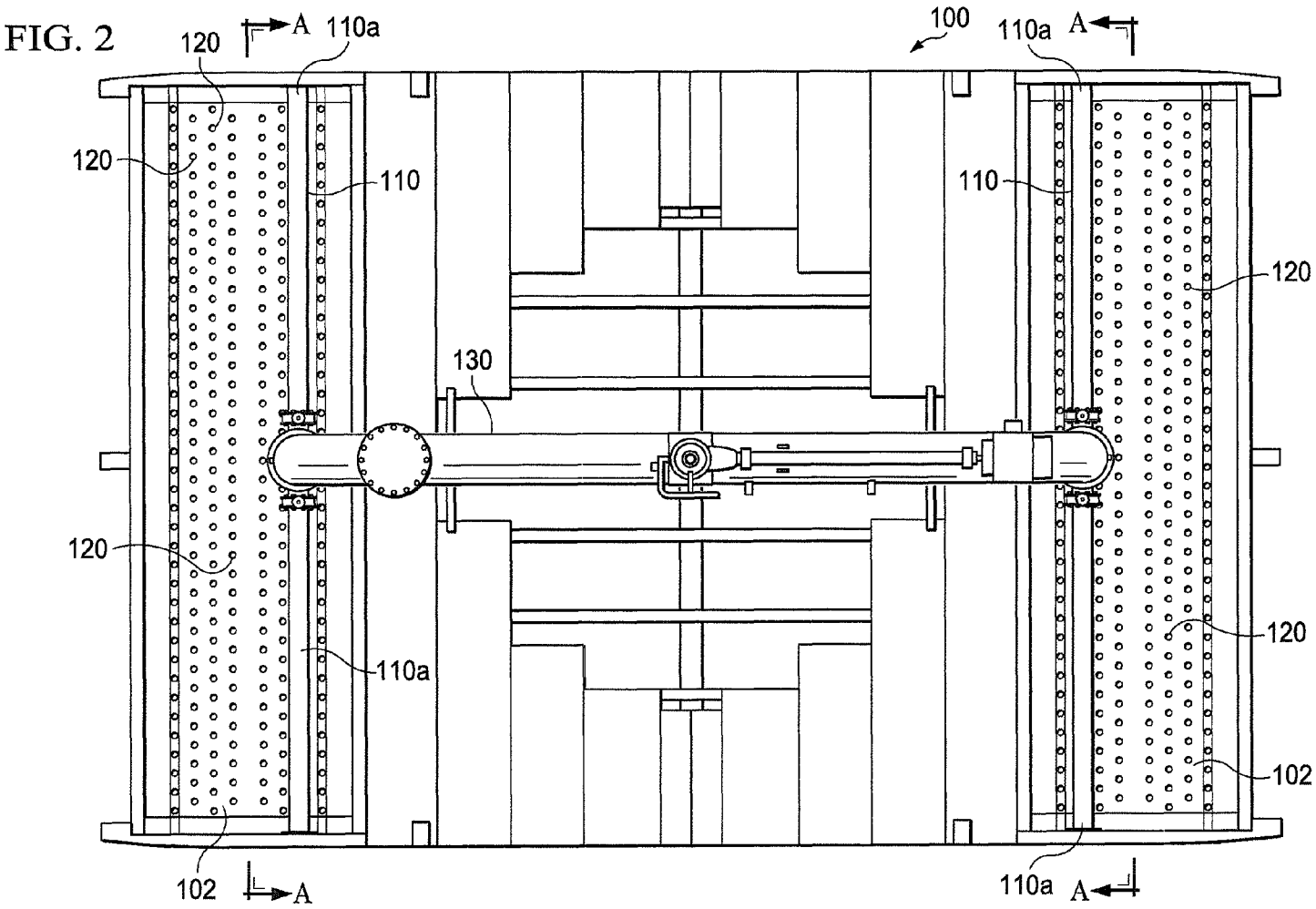
FIG. 2 is a plan view of a hot water basin distribution system in accordance with the present disclosure.
Figure 3:
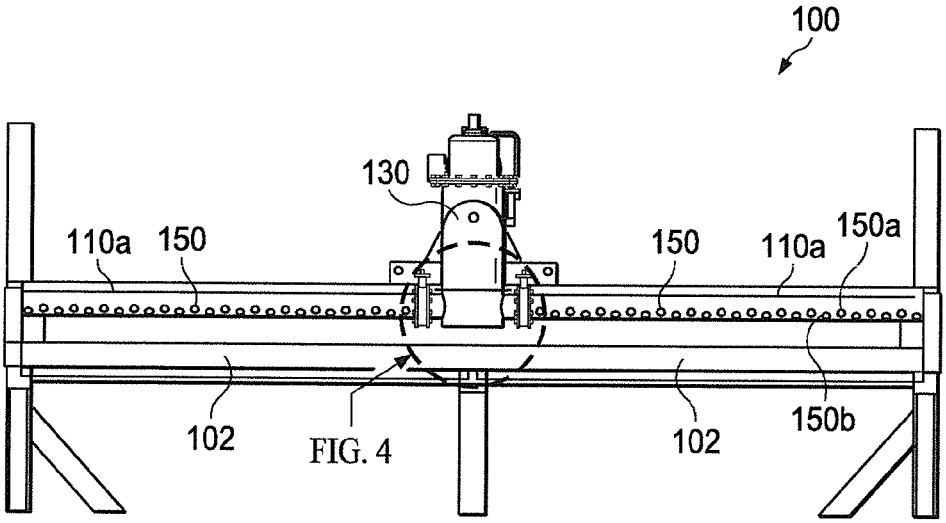
FIG. 3 illustrates the hot water basin distribution system along view A-A of FIG. 2.

Now referring to FIGS. 2 and 3, there is shown a plan view and view along A-A, respectively, of a hot water basin distribution system 100 in accordance with the present disclosure. The system 100 includes hot water reservoirs, basins or pans 102 (hereinafter referred to as "basin") each configured to receive hot water (or other cooling fluid) from a distribution lateral structure 110. The hot water basins 102 are formed to hold water, and can have various dimensions. In one embodiment, the hot water basins are rectangular in shape, include four side walls, and may be about 6-30 inches in depth, 2-8 feet in width, and 4 to 50 feet in length. Other dimensions may be utilized, depending on the particular configuration and size of the cooling tower. The hot water basins 102 further include multiple orifices, holes or passageways 120 (hereinafter referred to as an "orifice") for outletting water within the hot water basin 102 onto heat-exchanging material disposed below the basins 102 (not shown). Optionally, nozzles (not shown) may be affixed proximate the orifices 120 to receive water and distribute the water more evenly over and onto the fill material (not shown in FIGS. 2 and 3)). In one embodiment, the orifices 120 and nozzles (not shown) are configured or structured such that each nozzle snaps through the orifice 120 into the floor of the hot water basin 102.

The distribution lateral structure 110 is operably connected to a distribution header 130 that supplies the hot water to the distribution lateral structure 110 for dispensing into the hot water distribution basin 102. In one embodiment, the distribution lateral structure 110 is a fluid transporting pipe formed to distribute the incoming hot water over a large portion of the hot water basin 102. As illustrated, the distribution lateral 110 extends parallel or lateral along substantially the length of the hot water basin.

As shown in FIG. 2, the distribution lateral 110 receives fluid from the distribution header 130 at a single point—such as its midpoint. In other embodiments, and as will be appreciated, multiple discharge points into the distribution lateral 110 could be used, and these may be positioned or located at any point(s) along the distribution lateral. It will also be understood that the distribution lateral 110 may be formed of multiple components, such as two or more pipes, with each pipe coupled to an outlet chamber of the distribution header 130. Other configurations may be utilized.

While the distribution lateral 110 and the distribution header 130 are shown extending perpendicular and parallel, respectively, to the length of the hot water basin 102, any other suitable configuration may be utilized, such as a configuration in which the distribution lateral 110 extends parallel, while header extends perpendicular, to the length of the hot water basin 102.

Figure 4:
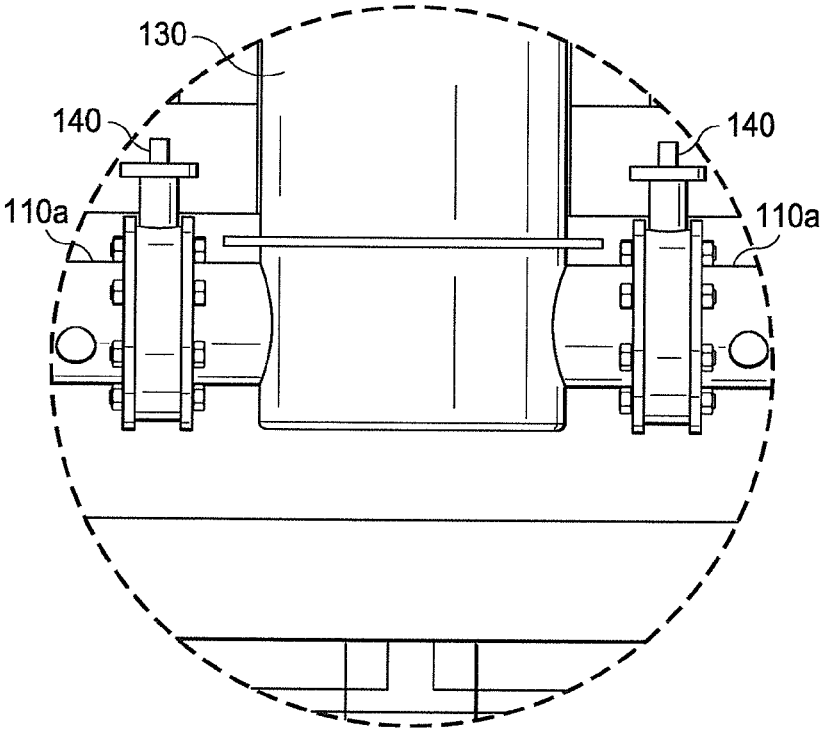
FIG. 4 is a more detailed diagram depicting a coupling between a distribution header and one or more distribution laterals shown in FIG. 4.

Turning to FIG. 4, there is illustrated one embodiment of the structures utilized for coupling the distribution header 130 to the distribution lateral 110. On opposite sides of the outlet chamber of the distribution header 130 are valves 140 which couple the distribution header outlet chamber(s) to the distribution laterals 110.

In the structural configuration illustrated in the FIGS. 3 and 4, the distribution lateral 110 is oriented at approximately right angles (substantially perpendicular) to the distribution header 130, and the distribution lateral 110 includes two laterals 110*a*. As will be appreciated, while FIG. 2 illustrates two hot water basins 102, each with a distribution header 130 which has distribution laterals 110*a*, any number and size of hot water basins 102, distribution headers 130 and distribution laterals 110*a* may be utilized, depending on the size and dimensions of the cooling tower, provided the distribution lateral 110 is positioned along a hot water basin 102 for discharge of the incoming hot water into the basin 102.

As shown in FIG. 3, the distribution lateral 110 is disposed at a predetermined distance above the floor 103 of the hot water basin 102. In various embodiments, this distance may be greater than about 3 inches, greater than about 6 inches, or greater than about 9 inches. In another embodiment, the distribution lateral 110 is disposed and affixed at a position such that at least a portion of distribution lateral 110 lies within the interior volume defined by the hot water basin 102 (defined by the floor and walls of the basin). In other embodiments, the distribution lateral 110 lies entirely within, or entirely outside, this interior volume.

The distribution lateral 110 is constructed with multiple distribution outlets 150 (orifices, holes, passageways)

spaced apart along a length of the distribution lateral 110. In one embodiment, the outlets 150 are spaced along substantially the length of the distribution laterals 110*a*. In another embodiment, the outlets 150 may be spaced in groups along one or more specific lengths of the laterals 110*a* while some other portion(s) of the laterals do not include the outlets 150.

In the embodiment shown in FIG. 3, the outlets are configured in two rows (as identified by reference numerals 150*a*, 150*b*) along the distribution lateral 110, with each row 150*a*, 150*b* spaced apart from each other, such as spaced circumferentially when the distribution lateral 110 is circular (such as a circular shaped pipe, in one embodiment). The distribution lateral 110 is formed and structured so that the outlets and rows are positioned to allow cooling fluid outlet into the hot water basin 102 that promotes a more even fluid flow within the hot water basin 102 to increase flow and efficiency.

As cooling fluid is discharged, multiple streams of fluid exit those outlets 150 within row 150*a* at a first angle (Angle A) with respect to the horizontal. See, FIG. 5C. Similarly, multiple streams of fluid exit those outlets 150 within row 150*b* at a second angle (Angle B) with respect to the horizontal. The physical location of the outlets 150 and rows in the distribution lateral 110 and the orientation of the distribution lateral 110 (as affixed in the system) will determine the angle of fluid discharge to the horizontal. The first angle (Angle A) is different from the second angle (Angle B).

In different embodiments, the first and second angles may range between about 5 degrees to about 85 degrees, between about 10 and about 80 degrees, between about 20 and about degrees and between about 30 and 60 degrees, from the horizontal. In one embodiment, the first angle is between about 20 degrees to about 40 degrees, and the second angle is between about 35 degrees to about 55 degrees, to the horizontal. In one specific embodiment, the first angle is about 30 degrees and the second angle is about 45 degrees. Though two rows are shown positioned at different circumferential points on the distribution lateral 110, it may be possible in one embodiment for the distribution lateral to operate with a single row 150*a* or 150*b* of outlets 150.

It will be appreciated that different angles may utilized depending on the dimensions of the hot water basin 102 and positioning of the distribution lateral 110 with respect to the basin 102, the diameter of the distribution lateral 110, the fluid flow rate, and the number and diameters of the outlets 150. It will be appreciated that the diameter of the distribution lateral 110 and the number and size of the outlets formed therein should be chosen to promote even fluid flow through the distribution lateral 110, wherein the fluid through the distribution lateral pipe has the least amount of velocity while maintaining enough fluid flow the pipe to fill its interior volume. Persons of ordinary skill in the art will be able to determine these variables without undue experimentation.

In one embodiment, the dimensions of the distribution lateral(s) pipes 110 and the outlets 150 are configured such that the cooling fluid discharge velocity is in the range of between about 0.5 to 2.5 feet/second. In another embodiment, the range is between about 1 to 1.5 feet/second.

As shown in FIG. 2, the distribution lateral 110 is shown positioned nearer one wall of the hot water basin 102 than the other opposite wall. In one embodiment, it is positioned proximate a wall of the hot water basin, the wall that is nearest the center of the cooling tower. However, it will be appreciated that the lateral 110 may be positioned at any point about the basin, such as at or near the center, or closer to one side or the other. In addition, multiple distribution laterals 110, spaced apart from each other but parallel to each other, may be used. Other configurations are possible.

Figure 5A:
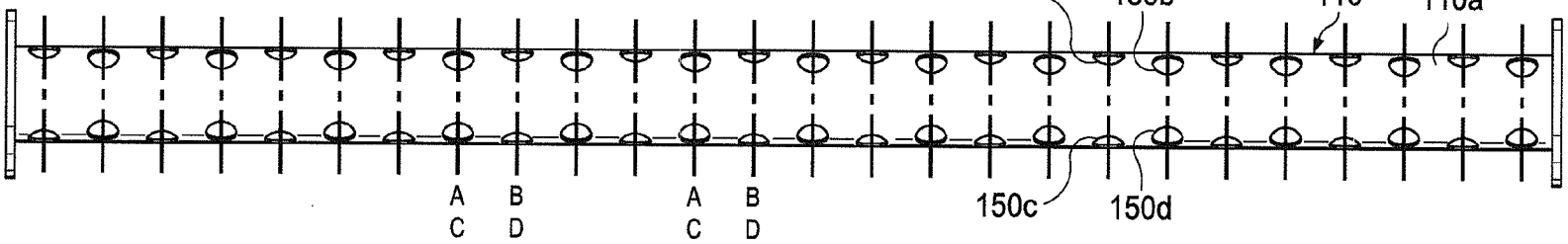
FIGS. 5A, 5B and 5C illustrate one embodiment of a distribution lateral for discharging fluid into the hot water basin received from a distribution header in accordance with the present disclosure.
Figure 5B:
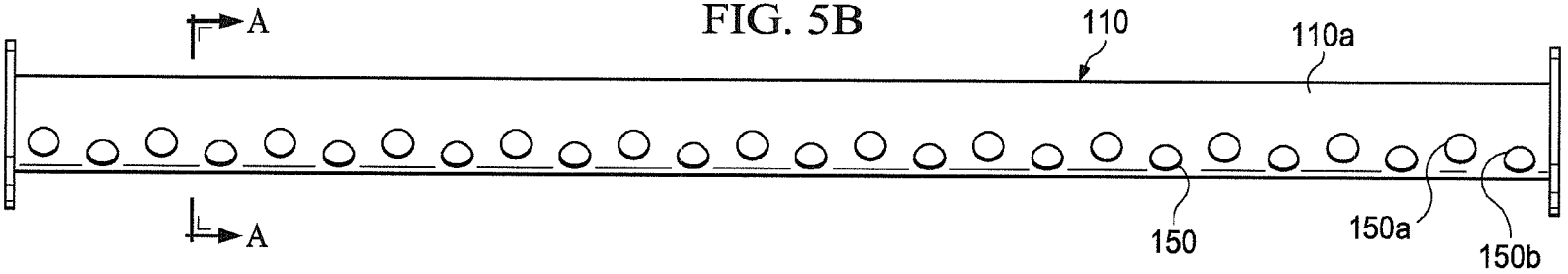
Figure 5C:
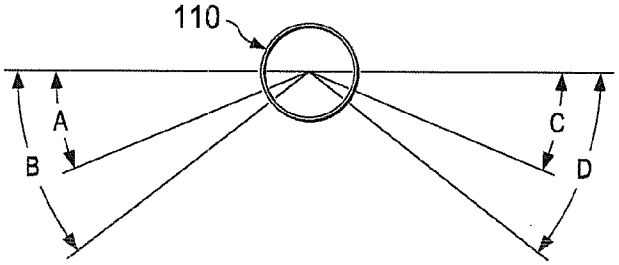

Now turning to FIGS. 5A-5C, there are shown FIG. 5A (bottom view), FIG. 5B (side view) and FIG. 5C (view along A-A of FIG. 5B) illustrating one embodiment of the distribution lateral 110 in accordance with this disclosure. Four rows 150*a*, 150*b*, 150*c* and 150*d* of discharge outlets 150 are shown extending along substantially the length of the lateral 110. Each of the rows is positioned on one side (circumferentially about one half, the lower half) of the distribution lateral 110, as shown. Thus, the angles of discharge for each of the rows can range from about 5 degrees to about 85 degrees (and as set forth above) to the horizontal.

The positioning and configuration of the outlet rows 150*a* ad 150*b* has been previously described (see above). The positioning and configuration of the outlet rows 150*c* and 150*d* are similar as that described above with respect to rows 150*a* and 150*b*, but from the horizontal on the other side of the distribution lateral 110. Reference to FIG. 5C illustrates this concept. As a result, in different embodiments, a third angle (Angle C) and a fourth angle (Angle D) may range between about 5 degrees to about 85 degrees, between about 10 and about 80 degrees, between about 20 and about 70 degrees and between about 30 and 60 degrees, from the horizontal. In one embodiment, the third angle is between about 20 degrees to about 35 degrees, and the fourth angle is between about 40 degrees to about 55 degrees, to the horizontal. In one specific embodiment, the third angle is about 30 degrees and the fourth angle is about 45 degrees.

FIG. 5C illustrates the fixed configuration of the distribution lateral 110 in one position located above the hot water basin. As shown, the rows of outlets 150*a*-150*d* are positioned such that fluid discharges at four different angles. This generates a more even fluid flow within the hot water basin 102 and results in a more even fluid flow over and onto the heat-exchanging material disposed below the hot water basin, resulting in increased thermal efficiency.

In the embodiment shown in FIG. 2, the distribution lateral 110 is positioned at a distance from one side wall of the hot water basin 102 such that the fluid discharged from the third row of outlets 120*c* and/or the fourth row of outlets 120*d* contacts the side wall of the hot water basin 102 or is discharged at the angle(s) such that it would contact the side wall when discharged if no fluid was present in the hot water basin 102.

In another configuration (not shown), the distribution lateral 110 may be positioned towards or at the center or midpoint of the hot water basin 102 such that a plurality of outlet rows, such as two or more of rows 150*a*, 150*b*, 150*c* or 150*d* are utilized such that cooling fluid is discharged towards both sides of the hot water basin 102. In another similar embodiment (not shown), the distribution lateral 110 may include a row of outlets (not shown) positioned at an angle of around 90 degrees to the horizontal (e.g., discharges fluid substantially vertically).

It will be understood that the cross-sectional shape of the distribution lateral pipe 110 may be circular, rectangular, or some other shape. Further, the shape of the outlets 150 may be circular, slotted, rectangular, oval or some other shape (or even a combination thereof). In addition, in different embodiments, the quantity of outlets 150 may range from about 10 to 100 per distribution lateral, may be greater than 20 per distribution lateral, and/or may range from about 3 to 10 per linear foot of distribution lateral.

Figure 6A:
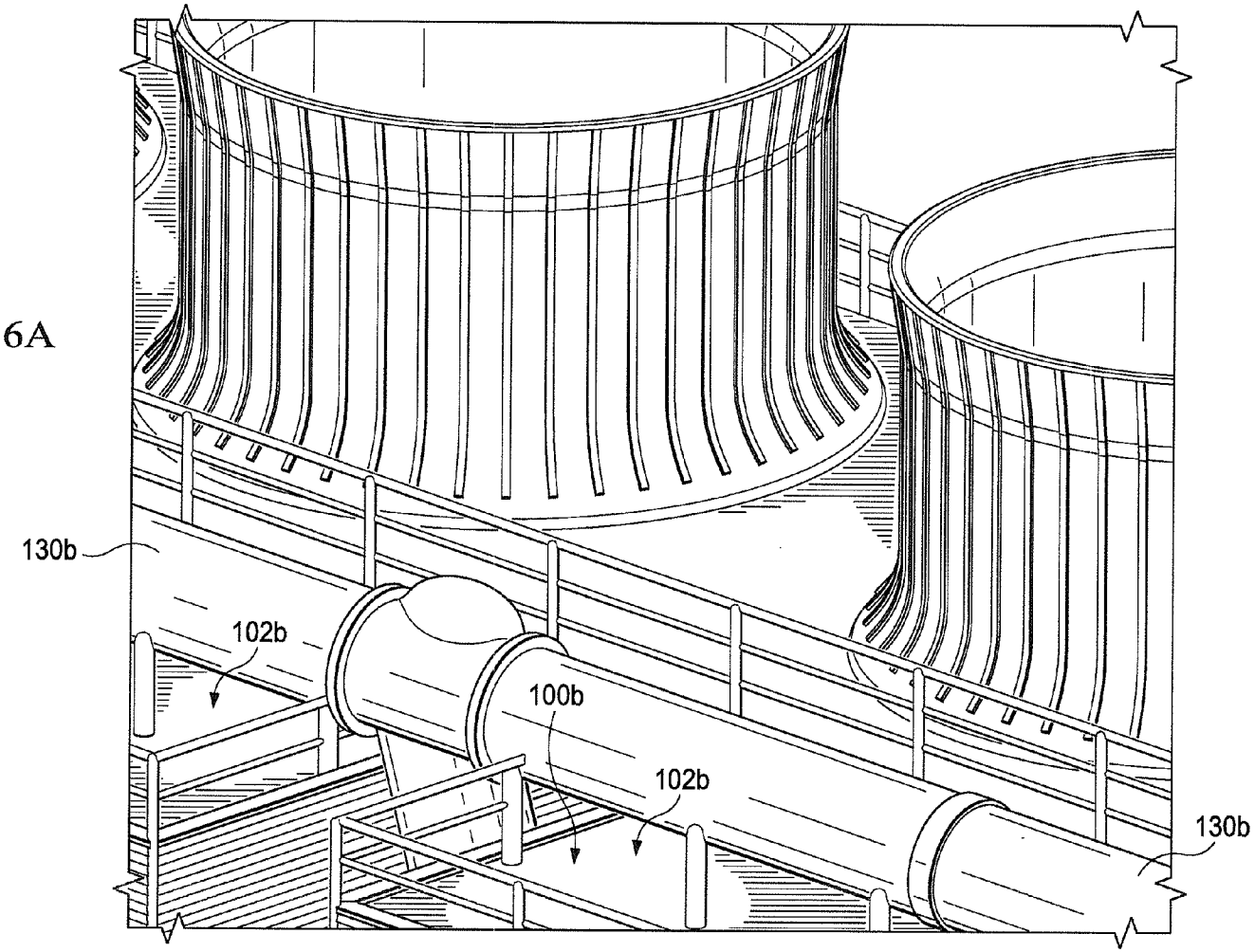
FIGS. 6A, 6B and 6C illustrate another embodiment of a hot water basin and distribution system and another embodiment of a distribution lateral.
Figure 6B:
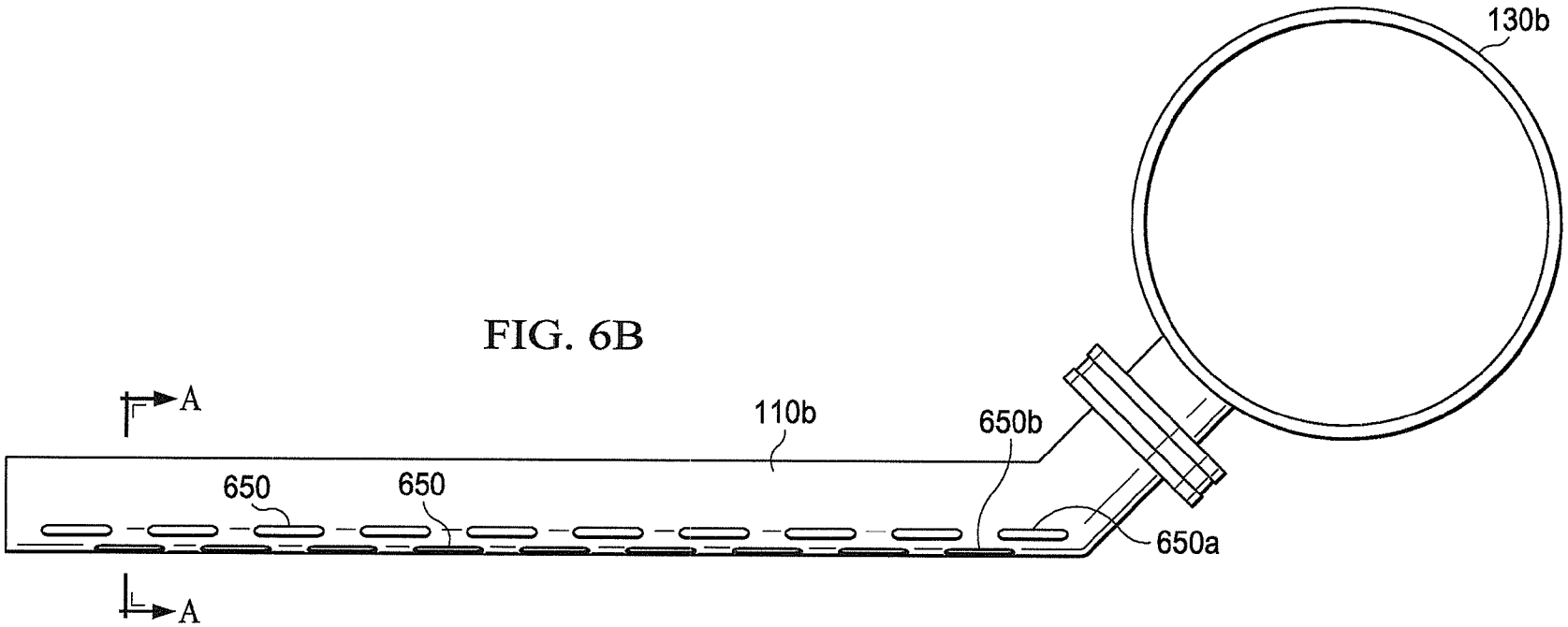
Figure 6C:
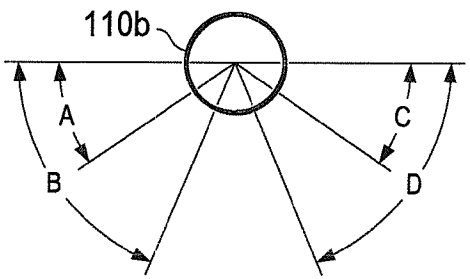

Now turning to FIGS. 6A-6C, there is shown a different embodiment of the hot water basin distribution system of the present disclosure. FIG. 6A illustrates a portion of another hot water basin distribution system 100*b* in which the distribution header 130*b* extends or runs parallel to the length of the hot water basin 102*b* (the distribution lateral(s) 110*b* are not shown in FIG. 6A, but they extend perpendicular to the distribution header 130*b*). FIG. 6B (side view) and FIG. 6C (view along A-A of FIG. 6B) illustrate the distribution lateral 110*b* in accordance with this disclosure. Two rows 650*a* and 650*b* of discharge outlets 650 are shown extending along substantially the length of the lateral 110*b*. Each of the rows is positioned on one side (circumferentially about one half, the lower half) of the distribution lateral 110*b*, as shown. Thus, the angles of discharge for each of the rows can range from about 5 degrees to about 85 degrees (and as set forth above) to the horizontal. Though not specifically shown in FIG. 6B (but illustrated by FIG. 6C, two additional rows 650*c* and 650*d* of discharge outlets are included.

In this embodiment, the outlets 650 have a slot or slotted shape. Other shapes may be utilized, as described above with respect to outlets 150.

As cooling fluid is discharged, multiple streams of fluid exit those outlets 650 within row 650*a* at a first angle (Angle A) with respect to the horizontal. See, FIG. 6C. Similarly, multiple streams of fluid exit those outlets 650 within row 650*b* at a second angle (Angle B) with respect to the horizontal. The physical location of the outlets 650 and rows in the distribution lateral 110*b* and the orientation of the distribution lateral 110*b* (as affixed in the system) will determine the angle of fluid discharge to the horizontal. The first angle (Angle A) is different from the second angle (Angle B).

In different embodiments, the first and second angles may range between about 5 degrees to about 85 degrees, between about 10 and about 80 degrees, between about 20 and about degrees and between about 30 and 50 degrees, from the horizontal. In one embodiment, the first angle is between about 30 degrees to about 40 degrees, and the second angle is between about 60 degrees to about 70 degrees, to the horizontal. In one specific embodiment, the first angle is about 35 degrees and the second angle is about 65 degrees. Though two rows are shown positioned at different circumferential points on the distribution lateral 110*b*, it may be possible in one embodiment for the distribution lateral to operate with a single row 650*a* or 650*b* of outlets 650.

It will be appreciated that different angles may be utilized depending on the dimensions of the hot water basin 102*b* and positioning of the distribution lateral 110*b* with respect to the basin 102*b*, the diameter of the distribution lateral 110*b*, the fluid flow rate, and the number and diameters of the outlets 650. It will be appreciated that the diameter of the distribution lateral 110*b* and the number and size of the outlets formed therein should be chosen to promote even fluid flow through the distribution lateral 110*b*, wherein the fluid through the distribution lateral pipe has the least amount of velocity while maintaining enough fluid flow the pipe to fill its interior volume. Persons of ordinary skill in the art will be able to determine these variables without undue experimentation.

In one embodiment, the dimensions of the distribution lateral(s) pipes 110*b* and the outlets 650 are configured such that the cooling fluid discharge velocity is in the range of between about 0.5 to 2.5 feet/second. In another embodiment, the range is between about 1 to 1.5 feet/second.

The positioning and configuration of the outlet rows 650*a* and 650*b* has been previously described (see above). The positioning and configuration of the outlet rows 650*c* and 650*d* are similar as that described above with respect to rows 650*a* and 650*b*, but from the horizontal on the other side of the distribution lateral 110*b*. Reference to FIG. 5C illustrates this concept. As a result, in different embodiments, a third angle (Angle C) and a fourth angle (Angle D) may range between about 5 degrees to about 85 degrees, between about 10 and about 80 degrees, between about 20 and about 70 degrees and between about 30 and 60 degrees, from the horizontal. In one embodiment, the third angle is between about 30 degrees to about 40 degrees, and the fourth angle is between about 60 degrees to about 70 degrees, to the horizontal. In one specific embodiment, the third angle is about 35 degrees and the fourth angle is about 65 degrees.

FIG. 6C illustrates the fixed configuration of the distribution lateral 110*b* in one position located above the hot water basin 102*b*. As shown, the rows of outlets 650*a*-650*d* are positioned such that fluid discharges at four different angles. This generates a more even fluid flow within the hot water basin 102*b* and results in a more even fluid flow over and onto the heat-exchanging material disposed below the hot water basin, resulting in increased thermal efficiency.

Figure 7:
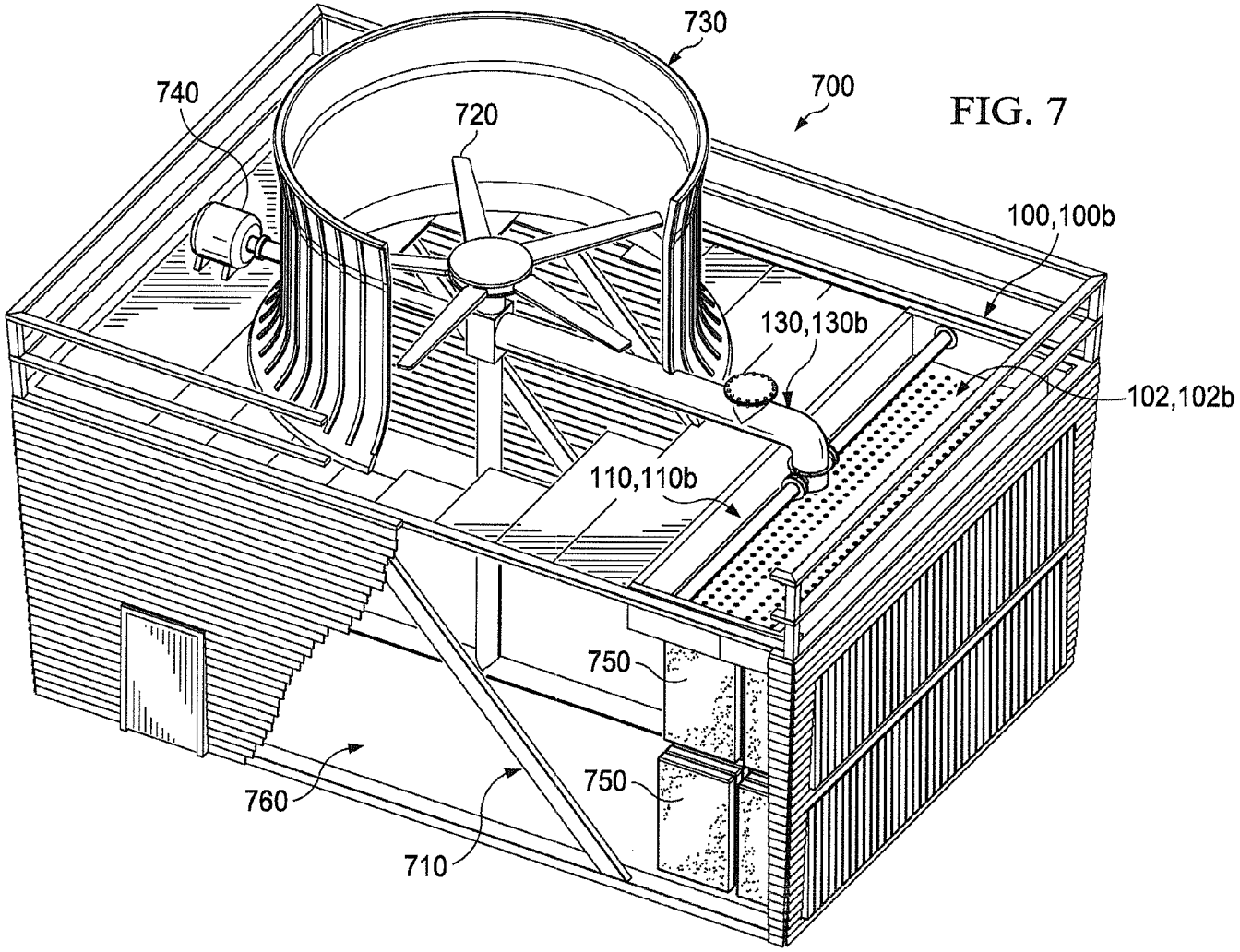
FIG. 7 illustrates a cooling tower in accordance with the present disclosure in which one or more of the hot water basis distribution systems and distribution laterals illustrated herein are integrated or incorporated.

Now turning to FIG. 7, there is shown a cooling tower 700 (in a partial cut-away view) in accordance with the present disclosure in which one or more of the hot water basin distribution systems 100, 100*b* and distribution laterals 110, 110*b* illustrated herein are integrated or incorporated. The cooling tower 700 includes a hot water distribution system 110, 100*b* that includes one or more distribution headers 130 (or 130*b*), one or more distribution laterals 110 (or 110*b*), and one or more hot water basins 102 (or 102*b*). The cooling tower 700 further includes a support structure 710 for supporting various cooling tower components, a fan 720, fan stack 730, a motor 740 for powering the fan 720, fill material 750 disposed below the hot water basin 102 (or 102*b*), and a cold water basin 760 for collecting the cooled fluid that passes through the fill material.

Within a method or process for cooling (e.g. reducing the temperature of the fluid received at an inlet port) fluid within the cooling tower 700, one or more distribution headers 130, 130*b* carry or distribute the fluid to one or more distribution lateral structures or pipes 110*a*, 110*b*. At this point, the fluid can be referred to as "hot fluid" having a first temperature. The distribution laterals 110*a*, 110*b* discharge the fluid into one or more hot water basins 102, 102*b* that include many orifices (holes, passageways) 120 usually positioned in the bottom of the basin. The basins 102, 102*b* are disposed above heat-exchanging or fill material 750, and the orifices 120 allow a gravity release of the fluid within the basin. In some systems, each orifice 120 is configured with a "target" nozzle to manipulate the fluid as it falls on the fill material 750. As fluid is released and output through the orifices 120 within the basin, the falling fluid contacts the fill material 750 below which assists in increasing the cooling rate (decreasing temperature) of the fluid as it flows over the fill material 750, which is then collected in a cold water basin 760 disposed below the fill material. At this point, the fluid can be referred to as "cold fluid" having a second temperature (less than the first temperature).

The distribution lateral 110*a*, 110*b* is configured structurally to discharge the fluid through a plurality of orifices (holes, passageways) 150, 650 at one or more angles (as compared to the horizontal) and into the hot water basins 102, 102*b*. In one embodiment, the orifices 150, 160 are organized into at least one row 150*a*, 650*a* that extends along some predetermined length of the lateral 110, 110*b* and positioned to discharge the fluid at the angle. In another embodiment, two rows 150*a*-150*b*, 650*a*-650*b* of orifices (extending along one or more lengths of the lateral) discharge the fluid at two respective angles. In another embodiment, four or more rows 150*a*-150*b*, 650*a*-650*d* may be utilized. As the fluid is discharged at the one or more angles by the one or more rows of discharge orifices 150, 650, this enhances and promotes a more even fluid flow within the hot water basin 102, 102*b* and results in a more even fluid flow over and onto the heat-exchanging material 750 disposed below the hot water basin 102, 102*b*, resulting in increased thermal efficiency.

It may be advantageous to set forth definitions of certain words and phrases that may be used within this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "couple" or "connect" refers to any direct or indirect connection between two or more components, unless specifically noted that a direct coupling or direct connection is present.

Although the present invention and its advantages have been described in the foregoing detailed description and illustrated in the accompanying drawings, it will be understood by those skilled in the art that the invention is not limited to the embodiment(s) disclosed but is capable of numerous rearrangements, substitutions and modifications without departing from the spirit and scope of the invention as defined by the appended claims.

What is claimed is:

1. A hot water basin distribution system for use in a cooling tower, the system comprising:

a hot water basin including a plurality of discharge orifices; and a distribution lateral pipe disposed over the hot water basin and extending substantially horizontally for receiving fluid from a distribution header pipe and discharging received fluid into the hot water basin, the distribution lateral pipe comprising, a plurality of discharge outlets formed within the distribution lateral pipe and arranged in a first row extending along a substantial length of the distribution lateral pipe, wherein the first row discharges fluid at a first angle from a horizontal of the distribution lateral pipe.

2. The system in accordance with claim 1 wherein the distribution lateral pipe comprises from about 3 to 10 outlets per linear foot.

3. The system in accordance with claim 2 wherein the the first row of outlets have a circular or slotted shape.

4. The system in accordance with claim 1 wherein the plurality of discharge outlets are further arranged in a second row extending along the substantial length of the distribution lateral pipe, wherein the second row discharges fluid at a second angle from a horizontal of the distribution lateral pipe.

5. The system in accordance with claim 4 wherein the first angle is between about 20 and 40 degrees and the second angle is between about 35 and 70 degrees.

6. The system in accordance with claim 4 wherein the plurality of outlets in the first row are positioned such that the outlets in the first row alternate with the outlets in the second row.

7. The system in accordance with claim 4 wherein the plurality of outlets in the first row and the second row have a circular or slotted shape.

8. The system in accordance with claim 7 wherein the number of outlets in the first and second rows is greater than about 20.

9. The system in accordance with claim 1 wherein the hot water basin includes two sidewalls opposite each other, and the distribution lateral pipe is positioned closer to one sidewall than the other sidewall.

10. A method of cooling fluid within a cooling tower, the method comprising:

distributing fluid carried by a distribution header within the cooling tower into a distribution lateral pipe;

discharging the fluid from the distribution lateral pipe through at least one row of discharge outlets arranged in a row along a substantial length of the distribution lateral pipe into a hot water basin;

releasing, through a plurality of orifices within the hot water basin, the fluid onto heat-exchanging material disposed below the hot water basin; and collecting the fluid in a cold water basin, the fluid in the cold water basin having a temperature less than a temperature of the fluid in the hot water basin.

11. The method in accordance with claim 10 wherein discharging the fluid further comprises:

discharging the fluid at a first angle from the distribution lateral pipe.

12. The method in accordance with claim 10 wherein discharging the fluid further comprises:

discharging the fluid from the distribution lateral pipe through a first row of discharge outlets at a first angle and through a second row of discharge outlets at a second angle.

13. The method in accordance with claim 12 wherein the first angle is different from the second angle.

14. The method in accordance with claim 13 wherein the first angle and the second angle are between about 20 and 70 degrees.

15. The method in accordance with claim 14 wherein the first angle is different than the second angle, and the first angle is between about 20 and 40 degrees and the second angle is between about 35 and 70 degrees.

16. The method in accordance with claim 12 wherein the plurality of outlets in the first row are positioned such that the outlets in the first row alternate with the outlets in the second row.

17. The system in accordance with claim 12 wherein the plurality of outlets in the first row and the second row have a circular or slotted shape.

18. A cooling tower for cooling fluid, the cooling tower comprising:

a supporting structure supporting a motor, a fan, a fan stack, fill material and a fluid distribution system; and wherein the fluid distribution system comprises, a distribution header, a reservoir basin including a plurality of discharge orifices, a distribution lateral disposed over the reservoir basin and extending substantially horizontally for receiving fluid from the distribution header and discharging received fluid into the reservoir basin, the distribution lateral comprising a plurality of discharge outlets formed therein and arranged in a first row extending along a substantial length of the distribution lateral pipe, wherein the first row discharges fluid at a first angle from a horizontal of the distribution lateral.

19. The cooling tower in accordance with claim 18 wherein:

the plurality of discharge outlets are further arranged in a second row extending along the substantial length of the distribution lateral, wherein the second row discharges fluid at a second angle from the horizontal of the distribution lateral; and the first angle is different from the second angle, and the first angle is between about 20 to 40 degrees and the second angle is between about 35 and 70 degrees.

20. The cooling tower in accordance with claim 19 wherein the number of outlets in the first and second rows is greater than about 20, and the shape of the outlets is at least a one of circular or slotted.

21. The system in accordance with claim 18 wherein the distribution lateral comprises from about 3 to 10 outlets per linear foot.

* * * * *